US012025124B2

(12) United States Patent
Wu et al.

(10) Patent No.: US 12,025,124 B2
(45) Date of Patent: Jul. 2, 2024

(54) ELECTRIC PUMP

(71) Applicant: NIDEC TOSOK CORPORATION, Kanagawa (JP)

(72) Inventors: Nan Wu, Kanagawa (JP); Nguyen Thi Thanh Tam, Kanagawa (JP)

(73) Assignee: NIDEC TOSOK CORPORATION, Kanagawa (JP)

( * ) Notice: Subject to any disclaimer, the term of this patent is extended or adjusted under 35 U.S.C. 154(b) by 84 days.

(21) Appl. No.: 17/697,928

(22) Filed: Mar. 18, 2022

(65) Prior Publication Data

US 2022/0307499 A1 Sep. 29, 2022

(30) Foreign Application Priority Data

Mar. 26, 2021 (JP) ..... 2021-052843

(51) Int. Cl.
*F03C 2/00* (2006.01)
*F01C 21/10* (2006.01)
(Continued)

(52) U.S. Cl.
CPC ..... *F04C 15/06* (2013.01); *F01C 21/10* (2013.01); *F04C 2/086* (2013.01); *F04C 2/102* (2013.01);
(Continued)

(58) Field of Classification Search
CPC ..... F04C 2/084; F04C 2/086; F04C 2/102; F04C 15/00; F04C 15/0026; F04C 15/0061; F04C 15/06; F04C 2240/30; F01C 21/10
See application file for complete search history.

(56) References Cited

U.S. PATENT DOCUMENTS 3,023,706 A * 3/1962 De Fezzy ..... F04C 2/082 418/206.1
7,156,623 B2 1/2007 Sakakibara et al.
(Continued)

FOREIGN PATENT DOCUMENTS

CN 104948527 B 2/2019
CN 211082239 U 7/2020
(Continued)

OTHER PUBLICATIONS

JP-2013241837-A—Kato—Electric Pump—Dec. 5, 2013—English Machine Translation. (Year: 2013).*
(Continued)

*Primary Examiner* — Theresa Trieu
(74) *Attorney, Agent, or Firm* — HAUPTMAN HAM, LLP

(57) ABSTRACT

An electric pump includes a motor unit rotationally driving a drive shaft, and a pump unit. The pump unit includes a pump rotor that sends the fluid by a driving force of the driving shaft, and a pump housing that covers at least one side of the pump rotor. The pump housing includes an attachment surface extending in the axial direction and in contact with an attached body, first and second flow paths respectively on the suction side and the discharge side, and a partition wall positioned between pump-side openings of the first flow path and the second flow path facing the pump rotor, and extends in a direction along the attachment surface, and locations of attachment-side openings of the first flow path and the second flow path on the attachment surface are displaced from each other on the attachment surface in the axial direction.

4 Claims, 6 Drawing Sheets

(51) Int. Cl.

| | |
|---|---|
| ***F03C 4/00*** | (2006.01) |
| ***F04C 2/00*** | (2006.01) |
| ***F04C 2/08*** | (2006.01) |
| ***F04C 2/10*** | (2006.01) |
| ***F04C 15/00*** | (2006.01) |
| ***F04C 15/06*** | (2006.01) |

(52) U.S. Cl.
CPC ..... *F04C 15/0026* (2013.01); *F04C 15/0061* (2013.01); *F04C 2240/30* (2013.01); *F04C 2240/40* (2013.01)

(56) References Cited

U.S. PATENT DOCUMENTS

| | | | | |
|---|---|---|---|---|
| 10,273,982 | B2 | 4/2019 | Tsutsui et al. | |
| 2004/0013541 | A1 | 1/2004 | Sakakibara et al. | |
| 2012/0224991 | A1* | 9/2012 | Lipinski | F04C 15/0069 418/152 |
| 2019/0234406 | A1* | 8/2019 | Homma | F04C 15/0096 |
| 2020/0003210 | A1 | 1/2020 | Kobayashi et al. | |

FOREIGN PATENT DOCUMENTS

| | | | | | |
|---|---|---|---|---|---|
| DE | 102019102745 | A1 * | 8/2020 | | F04C 2/102 |
| GB | 2069609 | A * | 8/1981 | | F02C 2/102 |
| JP | 2013241837 | A * | 12/2013 | | F04C 15/00 |
| JP | 2015105601 | A * | 6/2015 | | F04C 2/102 |
| JP | 2020067034 | A | 4/2020 | | |
| WO | 2011119464 | A2 | 9/2011 | | |
| WO | WO-2017104844 | A1 * | 6/2017 | | F04C 15/00 |

OTHER PUBLICATIONS

JP-2015105601-A—Akiyama et al.—Electric Pump—Jun. 8, 2015—English Machine Translation. (Year: 2015).*
WO-2017104844-A1—Higuchi et al.—Pump Device—Jun. 22, 2017—English Machine Translation. (Year: 2017).*
DE-102019102745-A1—Wahl—Internal Gear Pump—Aug. 6, 2020—English Machine Translation. (Year: 2020).*

* cited by examiner

ELECTRIC PUMP

CROSS-REFERENCE TO RELATED APPLICATIONS

The present invention claims priority under 35 U.S.C. § 119 to Japanese Patent Application No. 2021-052843 filed on Mar. 26, 2021, the entire content of which is incorporated herein by reference.

FIELD OF THE INVENTION

The present invention relates to an electric pump.

BACKGROUND

In the related art, an electric pump in which an attachment surface to an attached body is provided on a side in order to reduce an attachment space has been known.

For example, in the related art, an oil pump in which an attachment plate for a hydraulic device or the like is formed integrally with a pump housing is known. The attachment plate is positioned on a side of the pump housing, and a suction opening and a discharge opening extend in a direction of the attachment plate.

However, in the structure of the related art, the suction opening and the discharge opening are separated from each other in a radial direction of a motor, and the attachment plate greatly extends in the radial direction. As a result, a large space is required for attaching the oil pump.

SUMMARY

An aspect of an electric pump according to the present invention includes a motor unit that includes a drive shaft, and rotationally drives the drive shaft, and a pump unit that is positioned on one side in an axial direction along the drive shaft with respect to the motor unit, and sucks and discharges a fluid. The pump unit includes a pump rotor that sends the fluid from a suction side to a discharge side by rotating by a driving force of the driving shaft, and a pump housing that covers at least the one side of the pump rotor, the pump housing includes an attachment surface that extends in the axial direction and is in contact with an attached body, a first flow path and a second flow path in which the fluid flows, one flow path is on the suction side, and the other flow path is on the discharge side, a partition wall that is positioned between pump-side openings of the first flow path and the second flow path facing the pump rotor, and extends in a direction along the attachment surface, and locations of attachment-side openings of the first flow path and the second flow path on the attachment surface are displaced from each other on the attachment surface in the axial direction.

The above and other elements, features, steps, characteristics and advantages of the present disclosure will become more apparent from the following detailed description of the preferred embodiments with reference to the attached drawings.

DETAILED DESCRIPTION

Hereinafter, an embodiment of an electric pump according to the present disclosure will be described in detail with reference to the accompanying drawings. However, in order to avoid the following description from being unnecessarily redundant and to make it easier for those skilled in the art to understand, a detailed description more than necessary may be omitted. For example, detailed descriptions of well-known matters and duplicate description of substantially the same configuration may be omitted. Elements described in the figure described earlier may be appropriately referred to in the description of the later figure.

Figure 1:
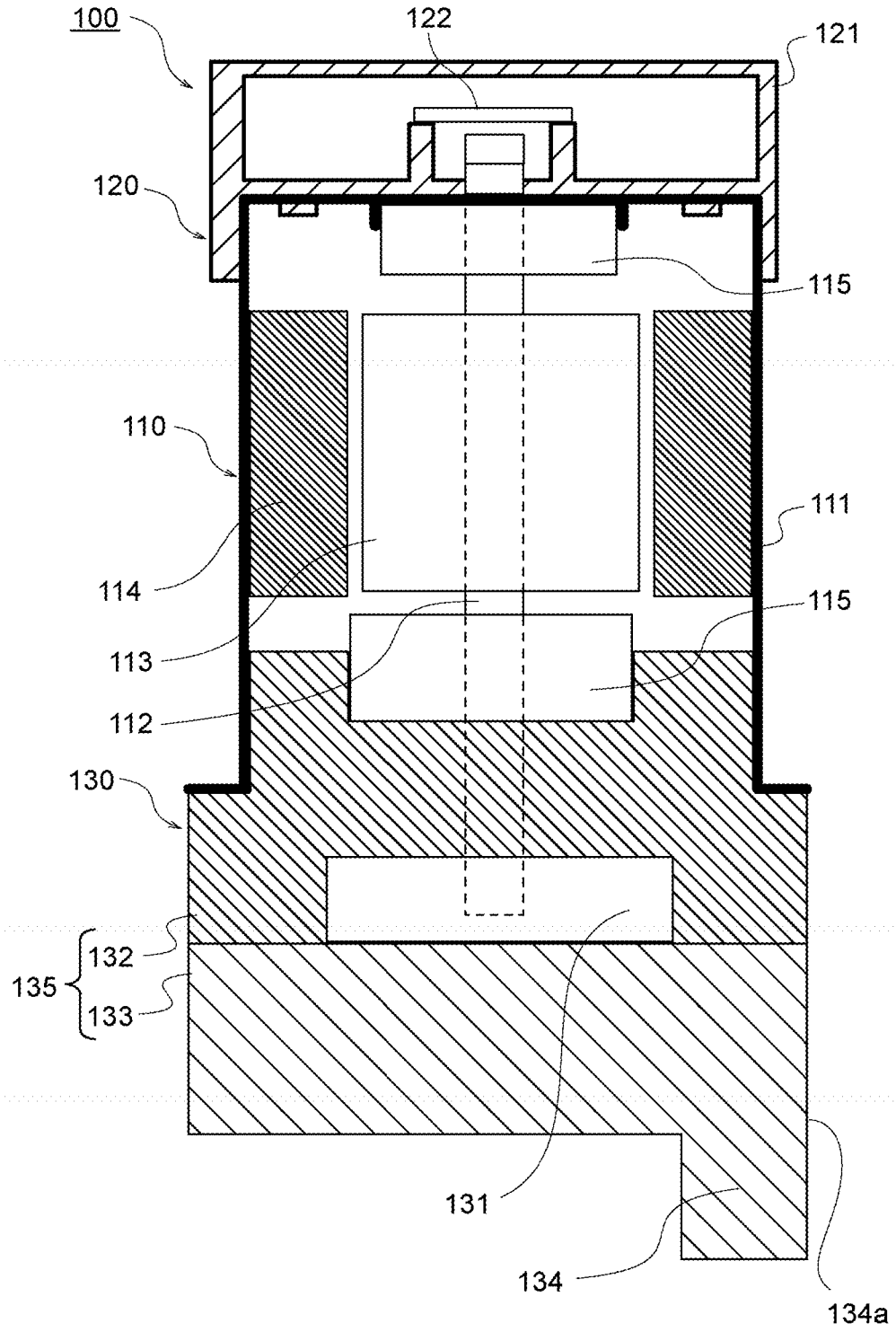
FIG. 1 is a diagram conceptually illustrating a structure of an oil pump.

FIG. 1 is a diagram conceptually illustrating a structure of an oil pump.

An oil pump 100 corresponds to an embodiment of the electric pump according to the present invention.

The oil pump 100 includes a motor unit 110, a sensor unit 120, and a pump unit 130.

The motor unit 110 receives electric power to generate rotational driving force.

The sensor unit 120 detects the rotation of the motor unit 110.

The pump unit 130 is driven by the motor unit 110 to suck and discharge oil.

The pump unit 130 corresponds to an example of a pump unit according to the present invention.

The motor unit 110 includes a motor housing 111, a drive shaft 112, a rotor 113, a stator 114, and bearings 115.

The drive shaft 112 is a member that transmits rotational driving force of the motor unit 110. That is, the motor unit 110 has the drive shaft 112, and rotationally drives the drive shaft 112.

In the following description, the drive shaft 112 is used as a reference for a direction, and a direction along the drive shaft 112 may be referred to as an axial direction. In the following description, regardless of the illustrated direction, a lower side in FIG. 1 may be referred to as one side in the axial direction, and an upper side in FIG. 1 may be referred to as the other side in the axial direction. In the following description, a direction in which the drive shaft 112 deviates perpendicularly to a rotation center line is referred to as a radial direction, a direction closer to the drive shaft 112 may be referred to as an inside in the radial direction, and a direction far from the drive shaft 112 may be referred to as an outside in the radial direction.

The motor housing 111 is a structure that supports the entire motor unit 110 and the oil pump 100, and is formed by, for example, pressing sheet metal. The motor housing 111 accommodates therein the rotor 113 and the stator 114.

The rotor 113 is fixed to the drive shaft 112, for example, has an incorporated permanent magnet, and rotates together with the drive shaft 112 by an action of a rotating magnetic field.

The stator 114 is accommodated in the motor housing 111 so as to face the rotor 113 to generate a rotating magnetic field. In the present embodiment, although an inner rotor type structure in which the stator 114 is disposed on an outside the rotor 113 in the radial direction is illustrated, the motor according to the present invention may have an outer rotor type structure in which the stator 114 is disposed on the inside of the rotor 113 in the radial direction.

The bearing 115 is, for example, a ball bearing and rotatably holds the drive shaft 112. The bearing 115 may be a roller bearing, a sliding bearing, or the like. The bearings 115 are arranged on one side in the axial direction and the other side in the axial direction with the rotor 113 interposed therebetween, for example, the bearing 115 on the other side in the axial direction is fixed to the motor housing 111, and the bearing 115 on one side in the axial direction is held by, for example, the pump unit 130.

The sensor unit 120 includes a board case 121, and an end portion of a conducting wire drawn from a coil of the stator 114 is guided to the board case 121. In the present embodiment, the board case 121 is used as a wiring lead-out space for the motor unit 110. The board case 121 accommodates therein and holds, for example, the sensor board 122. The sensor board 122 has a magnetic sensor, and detects, for example, a rotation position and a rotation speed of the drive shaft 112. The board case 121 may accommodate a control board or an inverter board together with the sensor board 122 or in place of the sensor board 122. The electric pump according to the present invention may not have the sensor unit 120.

The pump unit 130 has a pump rotor 131 and a pump housing 135. The pump unit 130 is disposed on one side of the motor housing 111 in the axial direction. In other words, the pump unit 130 is positioned on one side of the motor unit 110 in the axial direction along the drive shaft 112, and sucks and discharges a fluid (oil as an example). In the present embodiment, although the fluid is assumed to be oil, the following description is established for general fluids.

The pump rotor 131 rotates in the pump housing 135 by the driving force of the drive shaft 112 to send oil from the suction side to the discharge side.

Figure 2:
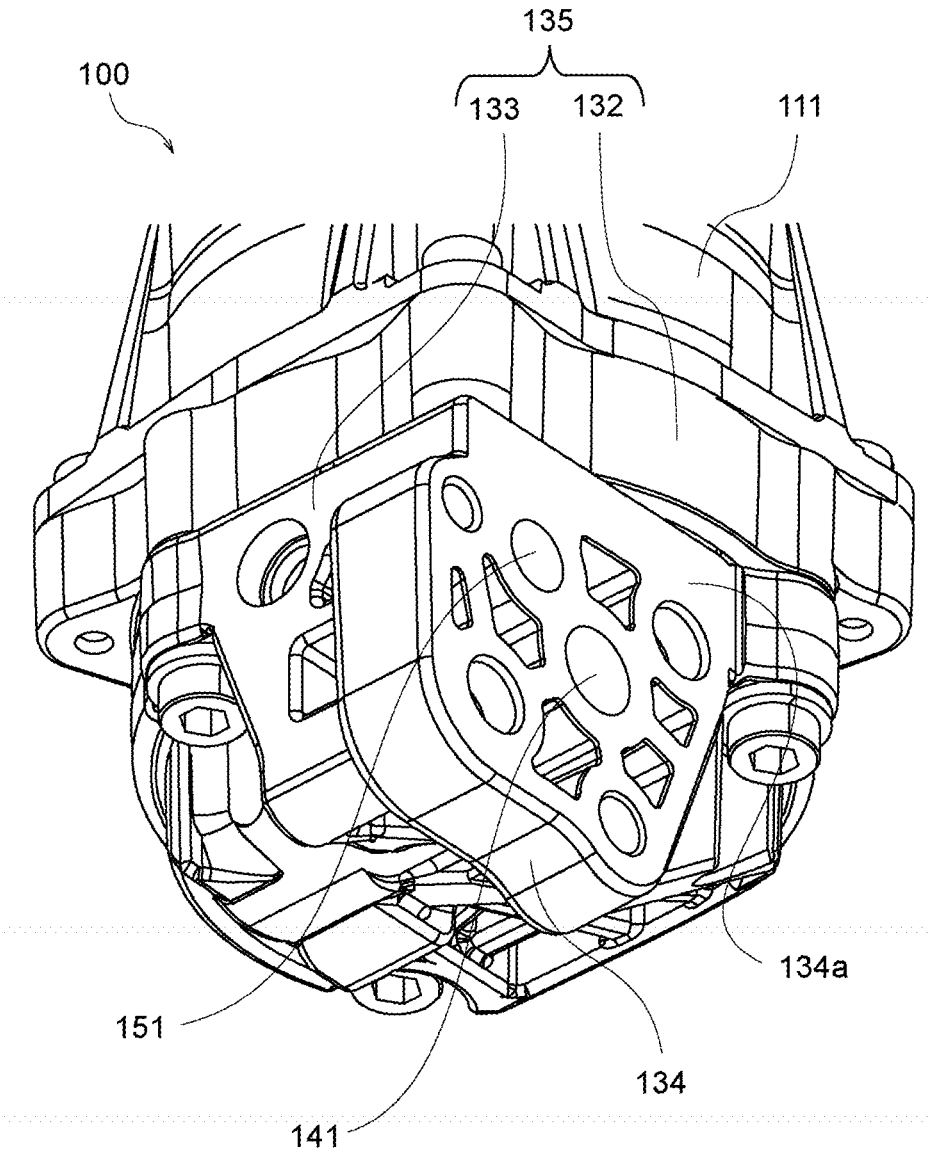
FIG. 2 is a diagram illustrating an appearance of a pump unit.

FIG. 2 is a diagram showing an appearance of the pump unit 130.

The pump housing 135 has a pump body 132 and a pump cover 133, accommodates the pump rotor 131, and is fixed to the motor housing 111. The pump housing 135 corresponds to an example of the pump housing according to the present invention, and covers the entire pump rotor 131 in the present embodiment.

In the present embodiment, the pump body 132 has an accommodation space for the pump rotor 131, and the pump cover 133 is a lid that covers the accommodation space and one side of the pump rotor 131 in the axial direction. However, in the pump housing according to the present invention, the pump cover 133 may have an accommodation space for the pump rotor 131, and the pump body 132 may be a bottom that covers the accommodation space and the other side of the pump rotor 131 in the axial direction.

The pump housing according to the present invention may cover at least one side of the pump rotor 131 in the axial direction. Thus, the pump housing according to the present invention may have, for example, only the pump cover 133 according to the present embodiment, and the accommodation space of the pump rotor 131 may be formed in the motor housing 111.

The pump cover 133 has an attachment portion 134 for attaching the oil pump 100 on an attached body to which the oil pump 100 is attached, for example, an oil pan of an automobile. The attachment portion 134 has an attachment surface 134*a* that extends in the axial direction, and the oil pump 100 is fixed to the attached body by, for example, a screw clamp in a state where the attachment surface 134*a* is in contact with the attached body. That is, the pump cover 133 which is a part of the pump housing 135 has the attachment surface 134*a* that extends in the axial direction and is in contact with the attached body.

The pump cover 133 which is a part of the pump housing 135 has a first flow path 140 (see FIG. 5) and a second flow path 150 (see FIG. 5) in which oil flows, one flow path is on the suction side and the other flow path is on the discharge side, and openings 141 and 151 of the first flow path 140 and the second flow path 150 are present on the attachment surface 134*a*. In the present embodiment, since the oil is sucked from the first flow path 140 side and is discharged to the second flow path 150 side, in the following description, the first flow path 140 may be referred to as a suction path 140, and the second flow path 150 may be referred to as a discharge path 150. When the opening 141 of the first flow path (suction path) 140 on the attachment surface 134*a* may be referred to as a suction opening 141, and the opening 151 of the second flow path (discharge path) 150 on the attachment surface 134*a* may be referred to as a discharge opening 151.

Figure 3:
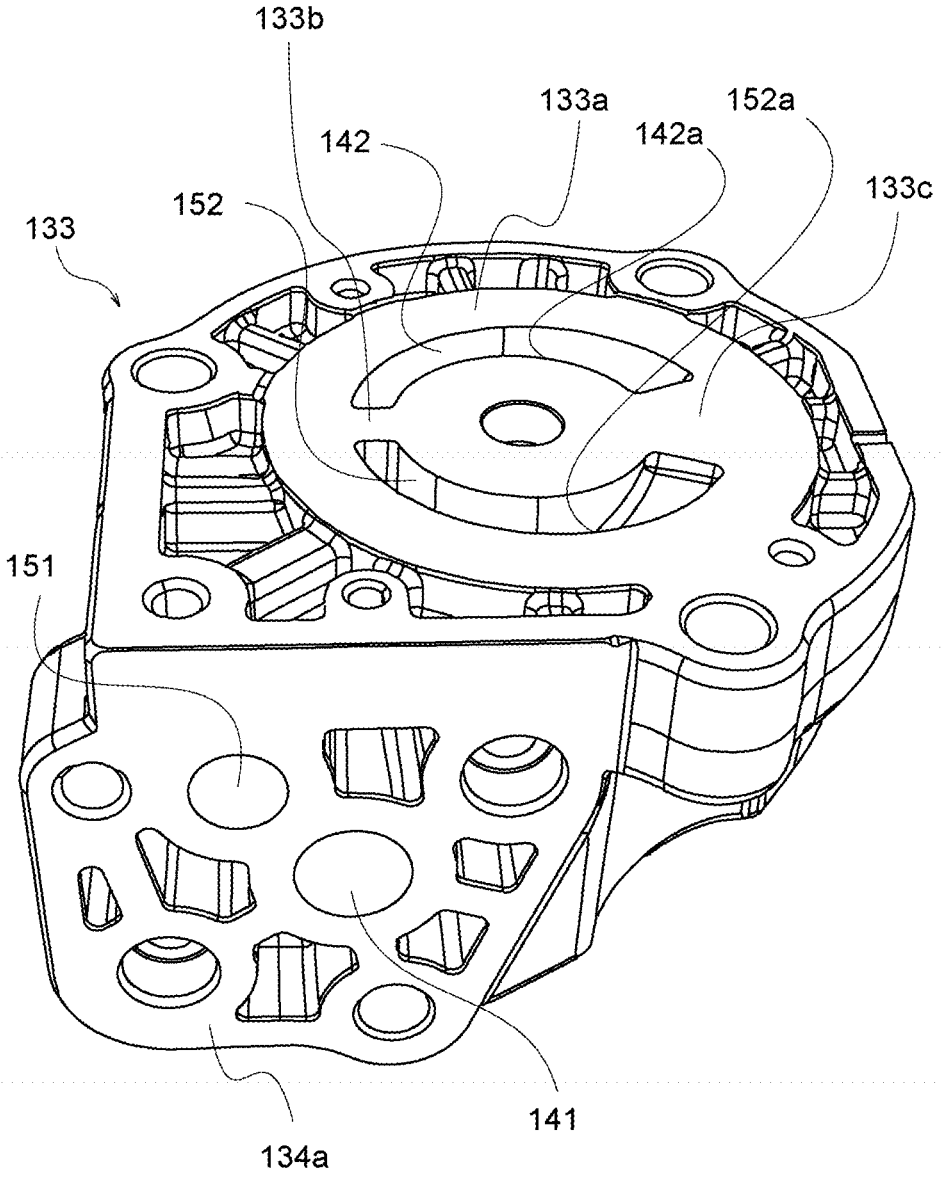
FIG. 3 is a perspective view illustrating an external structure of a pump cover.

FIG. 3 is a perspective view illustrating an external structure of the pump cover 133.

FIG. 3 illustrates the attachment surface 134*a* of the attachment portion 134, as well as the cover surface 133*a* covering the pump body 132 and the pump rotor 131.

An opening 142*a* of the suction path 140 and an opening 152*a* of the discharge path 150 are provided in the cover surface 133*a* of the pump cover 133, and each of the openings 142*a* and 152*a* is an arc-shaped opening extending in the circumferential direction around the drive shaft 112. The opening 142*a* of the suction path 140 and the opening 152*a* of the discharge path 150 are examples of a pump-side opening according to the present invention, and the pump-side opening according to the present invention may have a shape other than an arc shape.

A suction port 142 and a discharge port 152 recessed from the openings 142*a* and 152*a* on the cover surface 133*a* to one side in the axial direction are provided in the pump cover 133. That is, the pump cover 133 which is a part of the pump housing 135 has the ports (suction port 142 and discharge port 152) in which the suction path 140 and the discharge path 150 are recessed from the openings 142*a* and 152*a* to one side in the axial direction, respectively.

Here, an operation of the pump unit 130 will be described.

Figure 4:
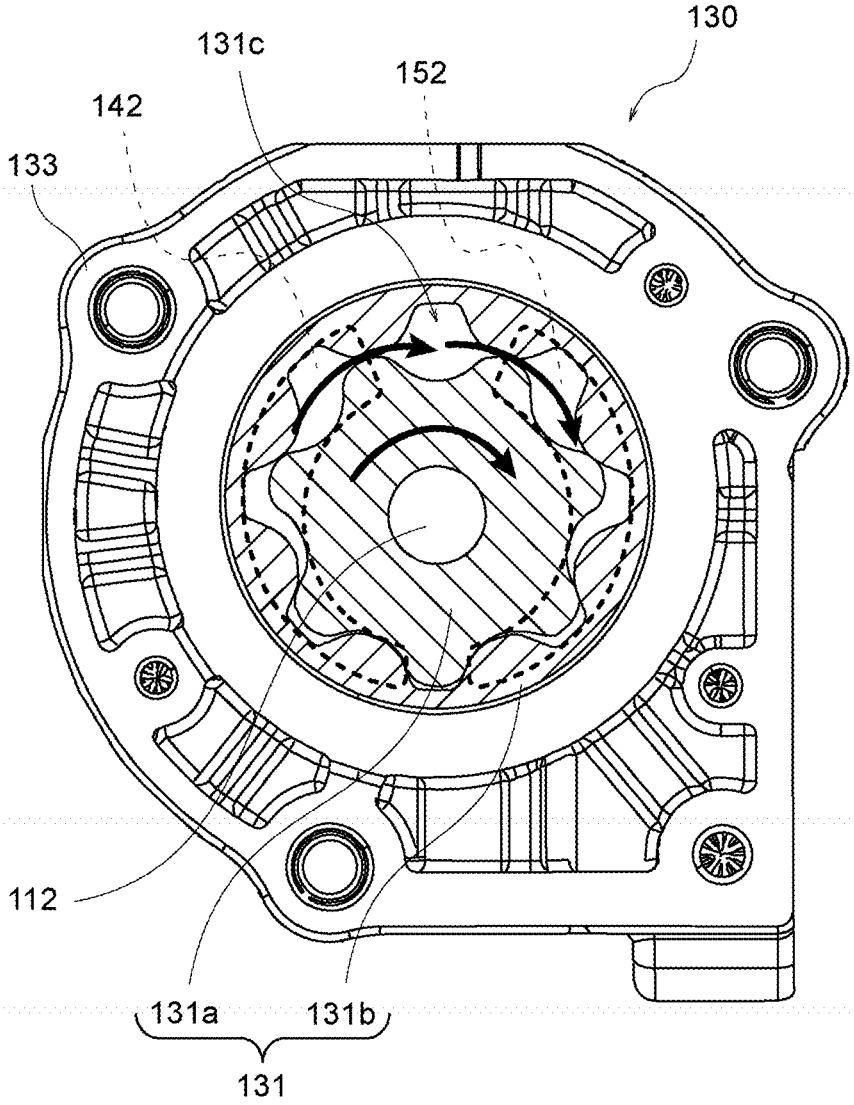
FIG. 4 is a diagram for describing an operation of the pump unit.

FIG. 4 is a diagram illustrating an operation of the pump unit 130.

The pump rotor 131 of the pump unit 130 has an inner rotor 131*a* fixed to the drive shaft 112 and an outer rotor 131*b* that meshes with the inner rotor 131*a*.

The suction port 142 and the discharge port 152 provided in the pump cover 133 are opened toward the pump rotor 131 side.

When the inner rotor 131*a* is rotationally driven together with the drive shaft 112, the outer rotor 131*b* rotates around a rotation center at a position different from a rotation center of the inner rotor 131*a*. Since the positions of the rotation centers are different between the inner rotor 131*a* and the outer rotor 131*b*, a room 131*c* in which oil enters is generated between the inner rotor 131*a* and the outer rotor 131*b*. The room 131*c* of the oil moves with the rotation of the pump rotor 131. For example, in the case of the clockwise rotation illustrated in FIG. 4, the room 131*c* of the oil also moves clockwise. As a result, the oil is sent from the suction port 142 side to the discharge port 152 side, and oil suction and discharge are realized.

The rotational driving of the drive shaft 112 is counter-clockwise opposite to the direction in FIG. 4, and thus, the oil suction and discharge are also in the opposite directions. However, for the sake of convenience in description, the drive shaft 112 and the pump rotor 131 are rotationally driven clockwise as illustrated in FIG. 4.

The description will be continued returning to FIG. 3.

The opening 142*a* of the suction path 140 and the opening 152*a* of the discharge path 150 are separated from each other by a partition wall 133*b*, and the partition wall 133*b* extends in parallel with the attachment surface 134*a*. That is, the pump cover 133 which is a part of the pump housing 135 has the partition wall 133*b* positioned between the openings 142*a* and 152*a* of the suction path 140 and the discharge path 150 facing the pump rotor 131 and extending in a direction along the attachment surface 134*a*.

Focusing on a positional relationship between the suction opening 141 and the discharge opening 151 on the attachment surface 134*a*, a position of the suction opening 141 and a position of the discharge opening 151 are displaced in the axial direction (upper-lower direction in the figure). In other words, locations of the openings (suction opening 141 and discharge opening 151) of the suction path 140 and the discharge path 150 on the attachment surface 134*a* are displaced from each other on the attachment surface 134*a* in the axial direction.

The openings 142*a* and 152*a* on the cover surface 133*a* are separated by the partition wall 133*b* in the direction along the attachment surface 134*a*, and thus, the locations of the suction path 140 and the discharge path 150 on the pump side are brought close to each other in the radial direction as viewed from the attachment surface 134*a* side. The suction opening 141 and the discharge opening 151 are displaced in the axial direction, and thus, the suction opening 141 and the discharge opening 151 can be brought close to each other in the radial direction. The entire size of the suction path 140 and the discharge path 150 in the radial direction is suppressed, and an increase in size of the attachment portion 134 having the attachment surface 134*a* is suppressed.

The openings 142*a* and 152*a* of the suction path 140 and the discharge path 150 are also separated from each other at a location 133*c* on a side opposite to the drive shaft 112 with the partition wall 133*b* interposed therebetween. When either the partition wall 133*b* or the opposite location 133*c* extends in the direction along the attachment surface 134*a*, the increase in size of the attachment portion 134 is suppressed.

The locations of the suction opening 141 and the discharge opening 151 on the attachment surface 134*a* are displaced from each other on the attachment surface 134*a* in a direction intersecting the axial direction (left-right direction in the figure). As a result, since the suction opening 141 and the discharge opening 151 can be brought close to each other in both the radial direction and the axial direction, the entire size of the suction path 140 and the discharge path 150 is suppressed in both the radial direction and the axial direction, and the increase in size of the attachment portion 134 is suppressed in both the axial direction and the radial direction.

Hereinafter, the detailed structures of the suction path 140 and the discharge path 150 will be described.

Figure 5:
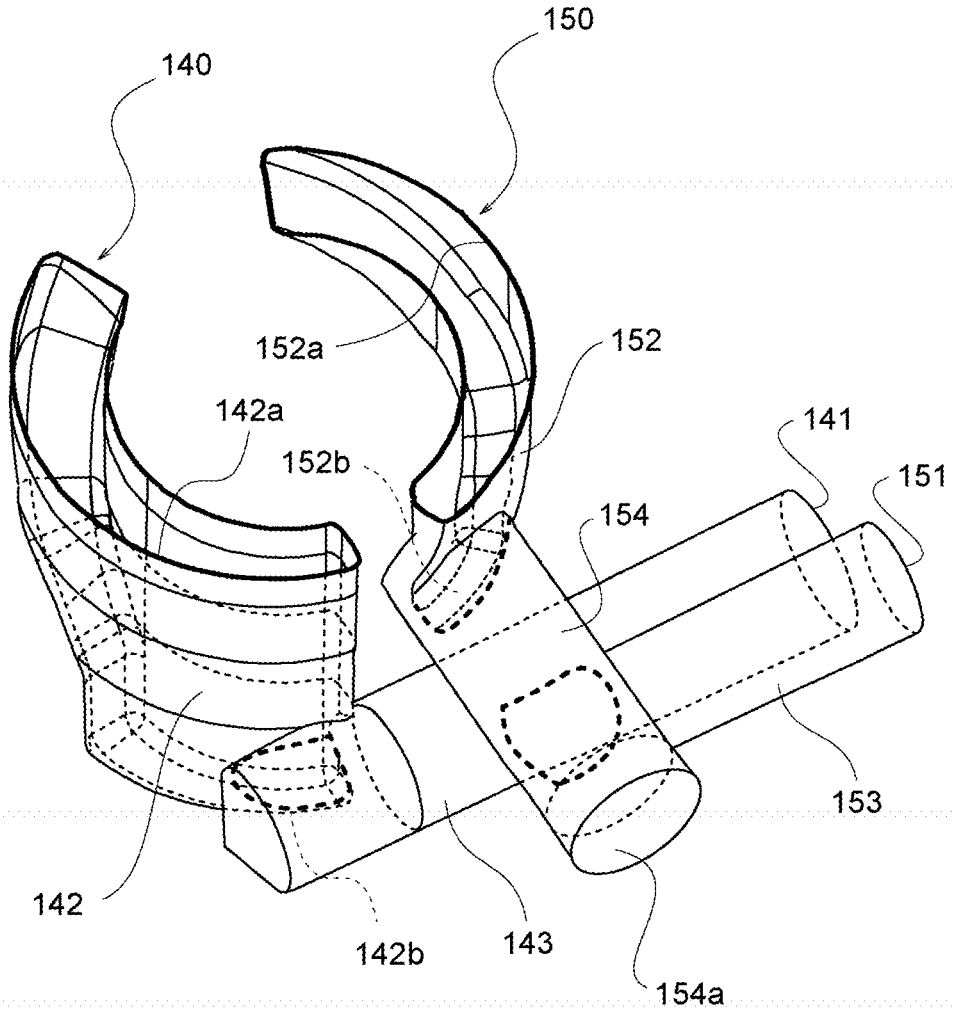
FIG. 5 is a structural diagram illustrating a structure of a suction path and a discharge path provided inside the pump cover.
Figure 6:
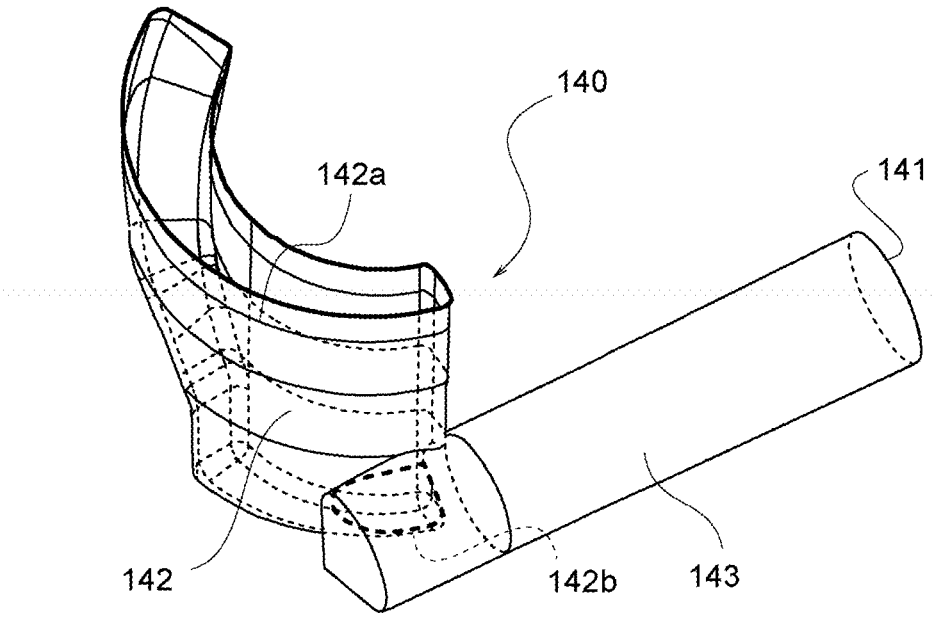
FIG. 6 is a detail view of the suction path.
Figure 7:
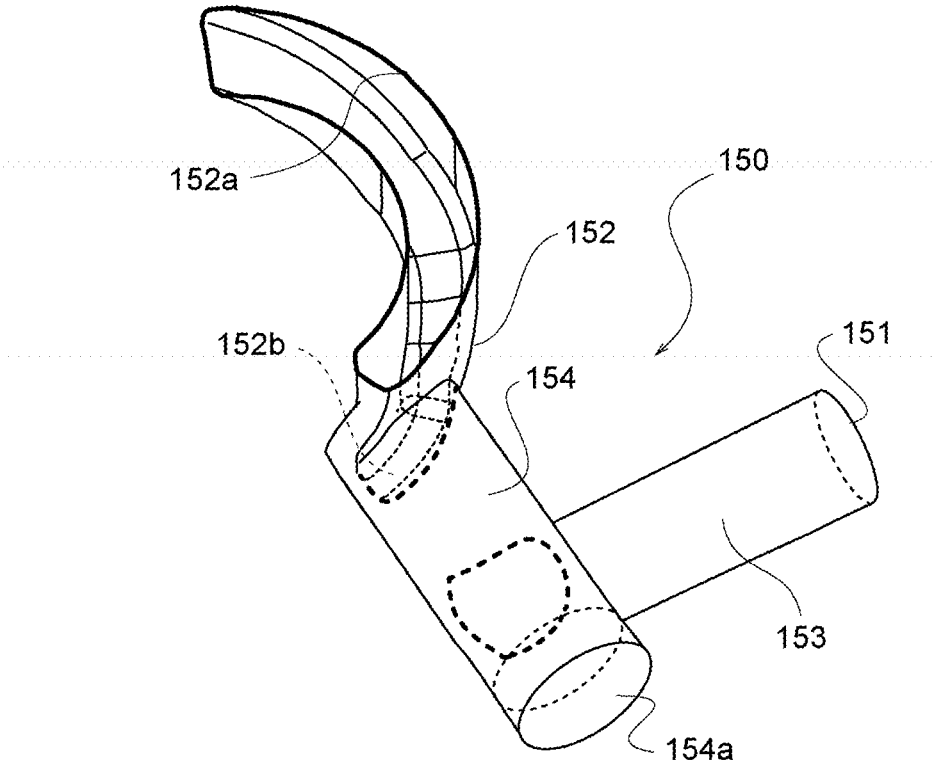
FIG. 7 is a detail view of the discharge path.

FIG. 5 is a structural diagram showing a structure of the suction path 140 and the discharge path 150 provided inside the pump cover 133, FIG. 6 is a detail view of the suction path 140, and FIG. 7 is a detail view of the discharge path 150.

The suction path 140 has the suction opening 141 and the suction port 142 described above. The suction path 140 has the extension portion 143 extending from the suction opening 141 in a direction intersecting with the attachment surface 134*a* and connected to the suction port 142.

The suction port 142 is recessed from the opening 142*a* facing the pump rotor 131 to one side in the axial direction, and the bottom on the one side in the axial direction is narrower than a width of the opening 142*a*. The suction port 142 is bent and extends in an arc shape as a whole, and one end 142*b* having an arc shape is connected to the extension portion 143. That is, the suction path 140 has the extension portion 143 that extends from the suction opening 141 toward the inside of the pump cover 133 that is a part of the pump housing 135 and connects to one end 142*b* of the suction port 142 in the circumferential direction. The extension portion 143 of the suction path 140 is easily formed by, for example, drilling perpendicularly to the attachment surface 134*a* from the attachment surface 134*a* side, for example, but may be formed by, for example, diagonally drilling the attachment surface 134*a*.

The discharge path 150 has the discharge opening 151 and the discharge port 152 described above. The discharge path 150 includes an attachment-side extension portion 153 extending from the discharge opening 151 in the direction intersecting the attachment surface 134*a*, and a pump-side extension portion 154 from the discharge port 152 in the direction intersecting the axial direction and extending to a direction along the attachment surface 134*a*.

The attachment-side extension portion 153 and the pump-side extension portion 154 are connected, but (the center line of) the attachment-side extension portion 153 and (the center line of) the pump-side extension portion 154 are at twisted positions that are displaced in the axial direction. An end portion 154*a* of the pump-side extension portion 154 opposite to the discharge port 152 is closed with a cap member (not illustrated).

In other words, the discharge path 150 includes the attachment-side extension portion 153 extending from the discharge opening 151 toward the inside of the pump cover 133 which is a part of the pump housing 135, and the pump-side extension portion 154 that extends from the attachment-side extension portion 153 to the direction intersecting both the attachment-side extension portion 153 and the axial direction and is connected to one end 152*b* of the discharge port 152 in the circumferential direction.

Due to the above-mentioned structures of the suction path 140 and the discharge path 150, there are few detour structures of the suction path 140 and the discharge path 150, and the increase in entire size of the suction path 140 and the discharge path 150 in the axial direction is suppressed.

The discharge port 152 is recessed from the opening 152*a* facing the pump rotor 131 to one side in the axial direction, and the bottom on one side in the axial direction is narrower than a width of the opening 152*a*. The bottom of the discharge port 152 is positioned on the other side in the axial direction as compared with the bottom of the suction port 142, and a depth of the suction port 142 from the opening 142*a* to the bottom is deeper than a depth of the discharge port 152 from the opening 152*a* to the bottom. That is, one ends 142*b* and 152*b* of the suction port 142 and the discharge port 152 are recessed toward one side in the axial direction in the suction path 140 than in the discharge path 150. The suction path 140 and the discharge path 150 intersect at a grade separation, and the extension portion 143 of the suction path 140 intersects the pump-side extension portion 154 of the discharge path 150 as viewed from the axial direction. The entire flow path of the oil is simplified by the grade separation of the suction path 140 and the discharge path 150, and thus, the increase in size of the attachment portion 134 can be suppressed.

The depths of the suction port 142 and the discharge port 152 are different, and thus, the grade separation structure in the suction path 140 and the discharge path 150 is further simplified. As a result, the entire flow path of the oil is further simplified, and the increase in size of the attachment portion 134 is suppressed.

Here, the oil pump is used as an example of the method of using the electric pump according to the present invention, but the method of using the electric pump according to the present invention is not limited to the above example. The electric pump according to the present invention can also be used as a pump that sucks and discharges water, air, and the like.

It is to be considered that the embodiment described above is illustrative in all aspects, and are not restrictive. The scope of the present invention is illustrated not by the above-described embodiment but by the scope of the claims, and is intended to include all changes within the meaning and scope equivalent to the scope of claims.

Features of the above-described preferred embodiments and the modifications thereof may be combined appropriately as long as no conflict arises.

While preferred embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. An electric pump comprising:

a motor that includes a drive shaft, and rotationally drives the drive shaft; and a pump that is positioned on one side in an axial direction along the drive shaft with respect to the motor, and sucks and discharges a fluid, wherein the pump includes a pump rotor that sends the fluid from a suction side to a discharge side by rotating by a driving force of the drive shaft, and a pump housing that covers at least the one side of the pump rotor, the pump housing includes an attachment surface that extends in the axial direction and is in contact with an attached body, a first flow path and a second flow path in which the fluid flows, one flow path is on the suction side, and the other flow path is on the discharge side, and a partition wall that is positioned between pump-side openings of the first flow path and the second flow path facing the pump rotor, and extends in a direction along the attachment surface, and locations of attachment-side openings of the first flow path and the second flow path on the attachment surface are displaced from each other on the attachment surface in the axial direction, wherein the locations of the attachment-side openings are displaced on the attachment surface in a direction intersecting the axial direction.

2. An electric pump comprising:

a motor that includes a drive shaft, and rotationally drives the drive shaft; and a pump that is positioned on one side in an axial direction along the drive shaft with respect to the motor, and sucks and discharges a fluid, wherein the pump includes a pump rotor that sends the fluid from a suction side to a discharge side by rotating by a driving force of the drive shaft, and a pump housing that covers at least the one side of the pump rotor, the pump housing includes an attachment surface that extends in the axial direction and is in contact with an attached body, a first flow path and a second flow path in which the fluid flows, one flow path is on the suction side, and the other flow path is on the discharge side, and a partition wall that is positioned between pump-side openings of the first flow path and the second flow path facing the pump rotor, and extends in a direction along the attachment surface, and locations of attachment-side openings of the first flow path and the second flow path on the attachment surface are displaced from each other on the attachment surface in the axial direction, wherein each of the pump-side openings of the first flow path and the second flow path is an arc-shaped opening extending a circumferential direction around the drive shaft, each of the first flow path and the second flow path has a port portion recessed from each of the pump-side openings of the first flow path and the second flow path to the one side in the axial direction, the first flow path has an extension portion that extends from one of the attachment-side openings toward an inside of the pump housing and is connected to one end of the port portion in the circumferential direction, and the second flow path has an attachment-side extension portion extending from the other one of the attachment-side openings toward the inside of the pump housing, and a pump-side extension portion that extends from the attachment-side extension portion to a direction intersecting the attachment-side extension portion and the axial direction and is connected to one end of the port portion in the circumferential direction.

3. The electric pump according to claim 2, wherein the one end of the port portion is recessed toward the one side in the axial direction in the first flow path than in the second flow path.

4. The electric pump according to claim 2, wherein the extension portion of the first flow path intersects the pump-side extension portion of the second flow path as viewed from the axial direction.

* * * * *